US009052144B2

(12) United States Patent
Kephart et al.

(10) Patent No.: US 9,052,144 B2
(45) Date of Patent: Jun. 9, 2015

(54) AUTOMATIC SANDING HOPPER SYSTEMS AND METHODS

(75) Inventors: Robert M. Kephart, Athens, AL (US); Kenneth R. Phillips, Athens, AL (US); Steven G. Huff, Decatur, AL (US); Kevin J. Defoor, Haleyville, AL (US); Samuel R. Cox, Florence, AL (US); Buford D. Lewis, Tuscumbia, AL (US); Scotty R. Proctor, Decatur, AL (US)

(73) Assignee: Nucor Corporation, Charlotte, NC (US)

( * ) Notice: Subject to any disclaimer, the term of this patent is extended or adjusted under 35 U.S.C. 154(b) by 244 days.

(21) Appl. No.: 13/484,026

(22) Filed: May 30, 2012

(65) Prior Publication Data

US 2013/0320601 A1 Dec. 5, 2013

(51) Int. Cl.

| | |
|---|---|
| ***F27D 99/00*** | (2010.01) |
| ***F27B 3/19*** | (2006.01) |
| ***F27B 3/06*** | (2006.01) |
| ***F27D 3/15*** | (2006.01) |

(52) U.S. Cl.

CPC . *F27B 3/19* (2013.01); *F27B 3/065* (2013.01); *F27D 3/1536* (2013.01)

(58) Field of Classification Search

CPC ..... F27D 99/00; F27D 21/02; F27D 25/001

USPC ..... 266/135, 271, 272

See application file for complete search history.

(56) References Cited

U.S. PATENT DOCUMENTS

2013/0320601 A1* 12/2013 Kephart et al. ..... 266/45

FOREIGN PATENT DOCUMENTS

JP 07-004852 A * 7/1995

* cited by examiner

*Primary Examiner* — Scott Kastler

(74) *Attorney, Agent, or Firm* — Moore & Van Allen PLLC; Jeffrey R. Gray

(57) ABSTRACT

Embodiments of the present invention relate to automatic sanding hopper systems and methods for supplying sand to a tap hole in a furnace. The automatic sanding hopper system may automatically open a chimney door to provide access to a furnace through a chimney hole. A hopper assembly in the sanding hopper system may automatically move to a position in which a plunger may automatically actuate to clear or clean out the chimney hole. The hopper assembly may thereafter automatically move to a position in which a sand dispenser delivers sand through the chimney hole, into the furnace, and into the tap hole in the furnace. A sensor device may determine whether or not the tap hole is properly filled with sand. The hopper assembly may automatically retract and the chimney door may automatically close to begin another steelmaking heat.

19 Claims, 13 Drawing Sheets

AUTOMATIC SANDING HOPPER SYSTEMS AND METHODS

BACKGROUND

During the steelmaking process, after the steel is melted and refining has begun, a tap hole is opened and the molten steel from the furnace is poured into ladles through the tap hole in the furnace (e.g., a bottom-tap hole, a tap door, etc.). After the molten steel is emptied out of the furnace, the furnace is prepped for another steelmaking heat (e.g., charging the bucket and melting the steel). In order to prepare the furnace for the subsequent steelmaking heat, sand is poured into the tap hole of the furnace from above. The sand in the tap hole prevents molten steel from exiting the furnace during melting and refining in the subsequent steelmaking heat.

SUMMARY OF THE EMBODIMENTS OF THE INVENTION

Embodiments of the present invention relate to automatic sanding hopper systems and methods for supplying sand to a tap hole in a furnace. The automatic sanding hopper systems may automatically open a chimney door to provide access to a furnace through a chimney hole. A hopper assembly in the sanding hopper system may be automatically moved to a position in which a plunger may be automatically actuated to clear or clean out the chimney hole. The chimney hole and the opening to the chimney hole may require clearing or cleaning because it may have remnants of built up steel and slag from the melting and refining processes that occur in the furnace. The hopper assembly may thereafter be automatically moved to a position in which a sand dispenser delivers sand through the chimney hole, into the furnace, and into the tap hole. The hopper assembly may be automatically retracted and the chimney door automatically closed to begin another steelmaking heat.

One embodiment of the invention is a sanding hopper system comprising a chimney assembly, a hopper assembly, a plunger, and a sand dispenser. The chimney assembly comprises a chimney door and chimney hole for accessing a furnace in a steelmaking facility. The chimney door is configured for opening and closing the chimney hole for access to the furnace. The hopper assembly is configured to hold sand. The plunger is configured to be removeably positioned over the chimney hole for removing steelmaking by-products from the chimney hole. The sand dispenser is configured to be removeably positioned over the chimney hole for supplying sand to a tap hole in the furnace between steelmaking heats.

In further accord with an embodiment of the invention the plunger is operatively coupled to the hopper assembly, and configured to be removeably positioned over the chimney hole by moving the hopper assembly into a first position different from a retracted position.

In another embodiment of the invention, the plunger is configured for removing steelmaking by-products from the chimney hole by actuating the plunger into at least a portion of the chimney hole, and thereafter, retracting the plunger from the chimney hole.

In still another embodiment of the invention, the plunger further comprises one or more projections for clearing by-products from the chimney hole.

In further accord with an embodiment of the invention, the sand dispenser is operatively coupled to the hopper assembly, and configured to be removeably positioned over the chimney hole by moving the hopper assembly into a second position different from a retracted position.

In another embodiment of the invention, the sand dispenser is opened to allow sand from the hopper to enter the tap hole in the furnace, and thereafter, is closed to stop the flow of sand into the furnace.

In yet another embodiment of the invention, the sanding hopper system further comprises an image capture device. The image capture device allows a user to determine if the by-products have at least been partially removed from the chimney hole or if the tap hole has been properly supplied with sand.

In still another embodiment of the invention, the sanding hopper system further comprises rails that are operatively coupled to a hopper support structure. The hopper assembly further comprises a hopper transport component and is configured to be operatively coupled to the rails. The hopper assembly is configured to move to various positions through the relative movement of the hopper transport component with respect to the rails.

In further accord with an embodiment of the invention, the chimney assembly further comprises rails and a door transport component that allows the chimney door to move to the open and closed positions through the relative movement of the door transport component with respect to the rails.

Another embodiment of the invention is a sanding hopper supply method. The method comprises automatically opening a chimney door to provide access to a chimney hole in order to access a tap hole in a furnace, and wherein the furnace is located at least partially below the chimney hole; automatically moving a plunger a position over the chimney door to remove by-products of steelmaking from the chimney opening; automatically removing the plunger from the position over the chimney door; automatically moving a sand dispenser to the position over the chimney door to dispense sand from a hopper into the tap hole in the furnace; automatically removing the sand dispenser from the position over the chimney door; and automatically closing the chimney door.

In further accord with an embodiment of the invention, the plunger is operatively coupled to a hopper assembly, and wherein the method step of automatically moving the plunger to, and automatically removing the plunger from, the position over the chimney door comprises automatically moving the hopper assembly to two or more positions.

In another embodiment of the invention the sanding hopper supply method, further comprises automatically actuating the plunger into at least a portion of the chimney hole; and thereafter automatically retracting the plunger from the chimney hole to remove steelmaking by-products from the chimney hole.

In still another embodiment of the invention, the plunger further comprises one or more projections for clearing by-products from the chimney hole.

In yet another embodiment of the invention, the sand dispenser is operatively coupled to a hopper assembly, and wherein the method step of automatically moving the sand dispenser to and automatically removing the sand dispenser from the position over the chimney door comprises automatically moving the hopper assembly to two or more positions.

In further accord with an embodiment of the invention, the sanding hopper supply method further comprises automatically opening the sand dispenser to allow sand from the hopper to enter the tap hole in the furnace, and automatically closing the sand dispenser to stop the flow of sand into the tap hole.

In another embodiment of the invention, the sanding hopper supply method further comprises determining, through the use of an image capture device, when the by-products have at least been partially removed from the chimney hole or when the tap hole has been properly supplied with sand.

In still another embodiment of the invention, the hopper, plunger, and the sand dispenser comprise a hopper assembly, wherein the hopper assembly further comprises a hopper transport component and is configured to be operatively coupled to rails in a sanding hopper system. Furthermore, the step of automatically moving and automatically removing the plunger and the sand dispenser comprises automatically moving the hopper assembly to various positions through the relative movement of the hopper transport component with respect to the rails.

In yet another embodiment of the invention, automatically opening a chimney door to provide access to the chimney hole and automatically closing the chimney door comprises automatically opening and automatically closing the chimney door using rails and a door transport component that allows the chimney door to move to the open and closed positions through the relative movement of the transport component with respect to the rails.

Another embodiment of the sanding hopper system, comprises a hopper assembly, a plunger, and a sand dispenser. The hopper assembly is configured to hold sand and dispense sand through a chimney hole into a tap hole in a furnace. The plunger is configured to be removeably positioned over the chimney hole for removing steelmaking by-products from the chimney hole. The sand dispenser is operatively coupled to the hopper assembly, and is configured to be removeably positioned over the chimney hole for supplying sand to the tap hole in the furnace between steelmaking heats.

In further accord with an embodiment of the invention, the sanding hopper system further comprises a chimney assembly. The chimney assembly comprises a chimney door and the chimney hole for accessing the furnace in a steelmaking facility, and the chimney door is configured for opening and closing the chimney hole for access to the furnace.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE SEVERAL VIEWS OF THE DRAWINGS

The accompanying drawings illustrate preferred embodiments of the present disclosure, in which.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 2:
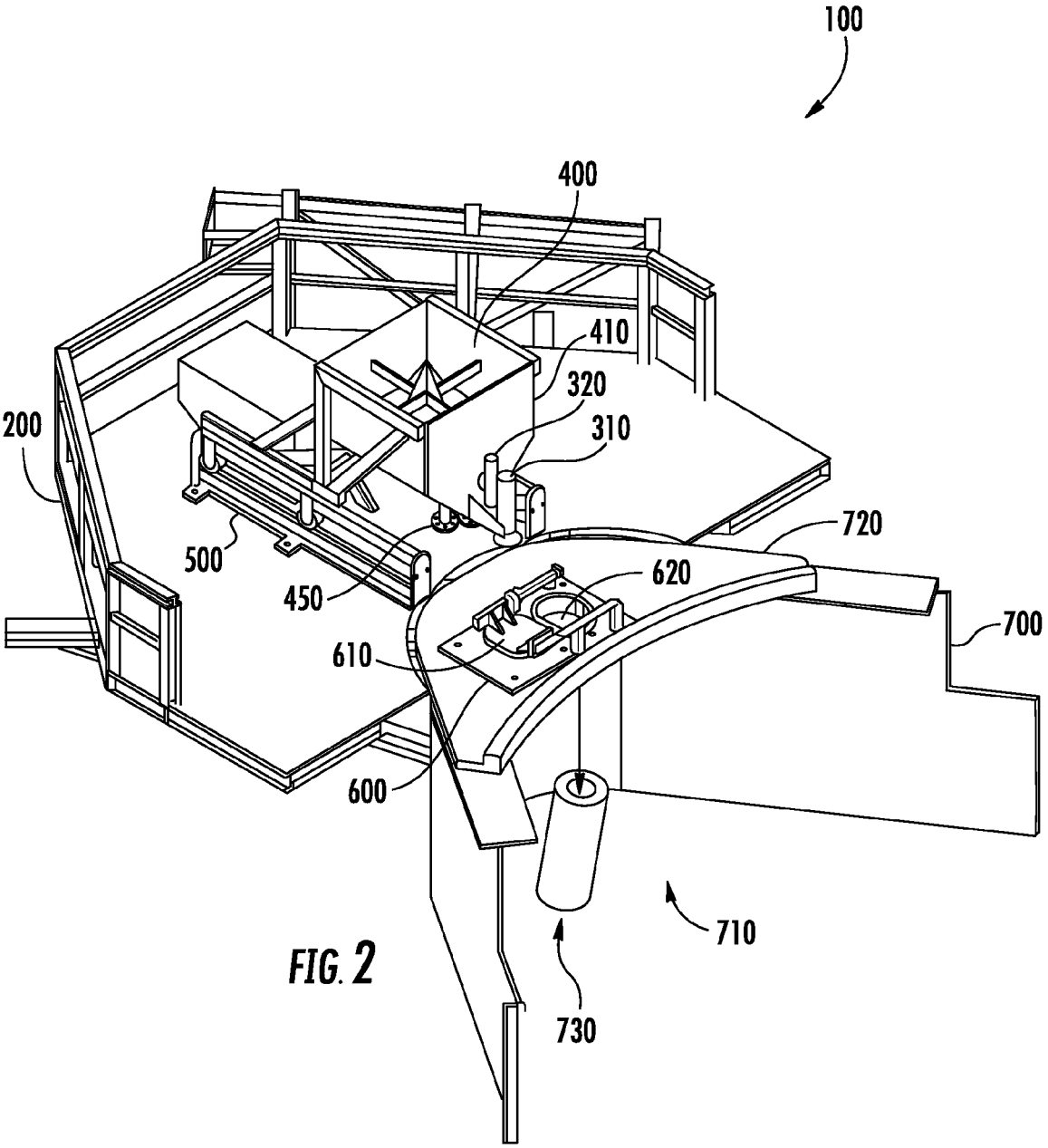
FIG. 2 is a perspective view of the sanding hopper system, in accordance with one embodiment of the invention.
Figure 3A:
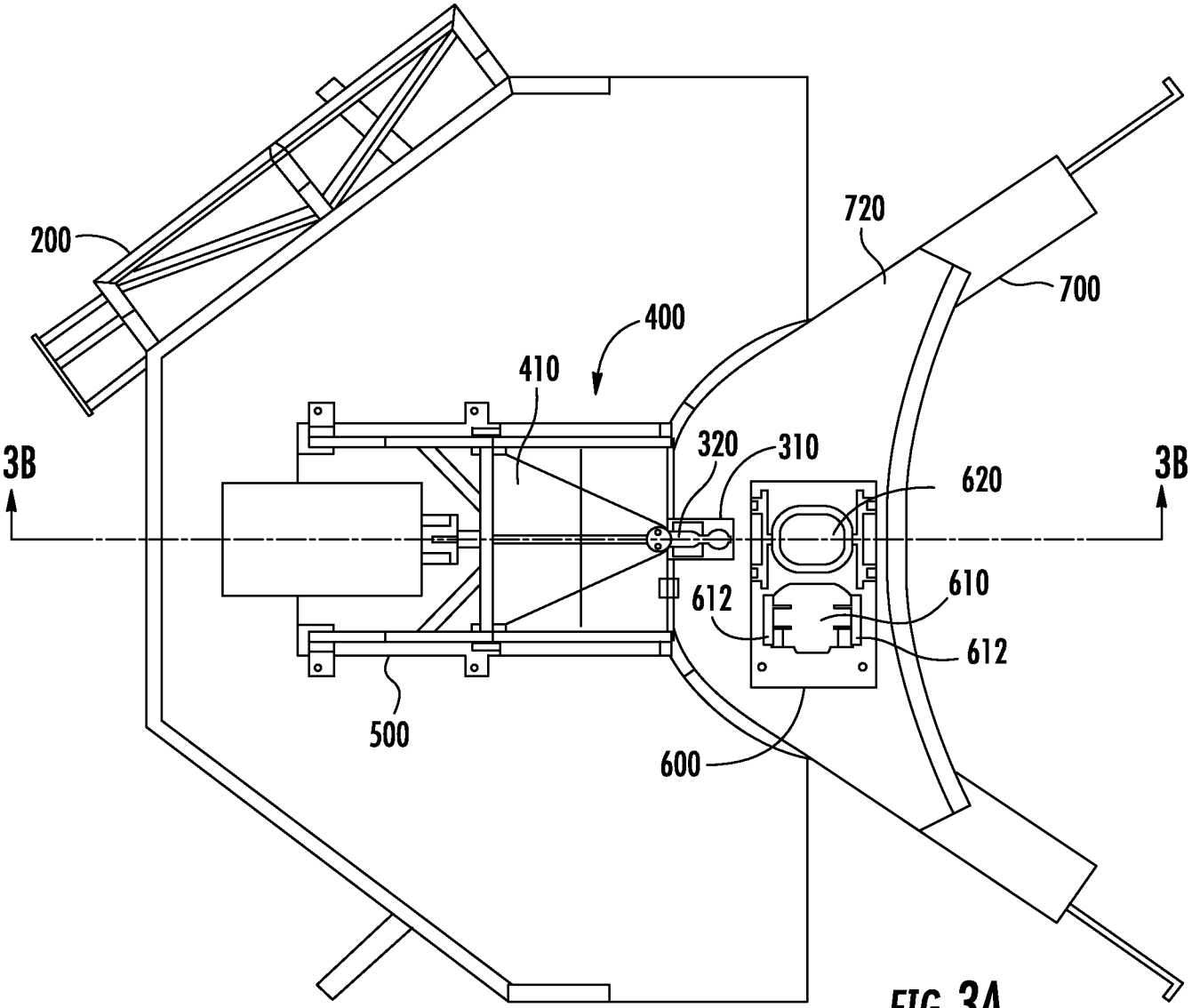
FIG. 3*a* is a top view of the sanding hopper system, in accordance with one embodiment of the invention.
Figure 3B:
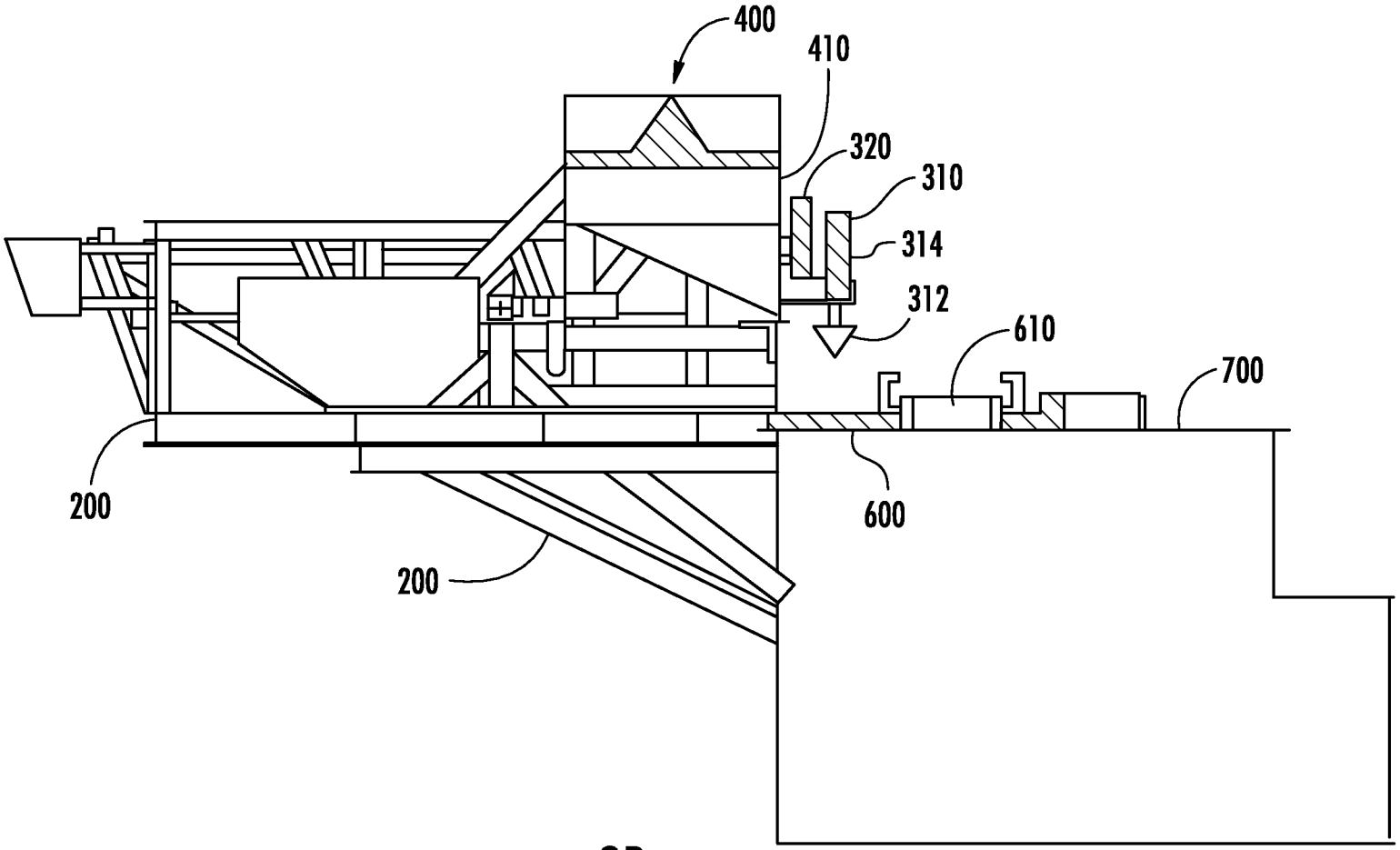
FIG. 3*b* is a side view of the sanding hopper system, in accordance with one embodiment of the invention.
Figure 4A:
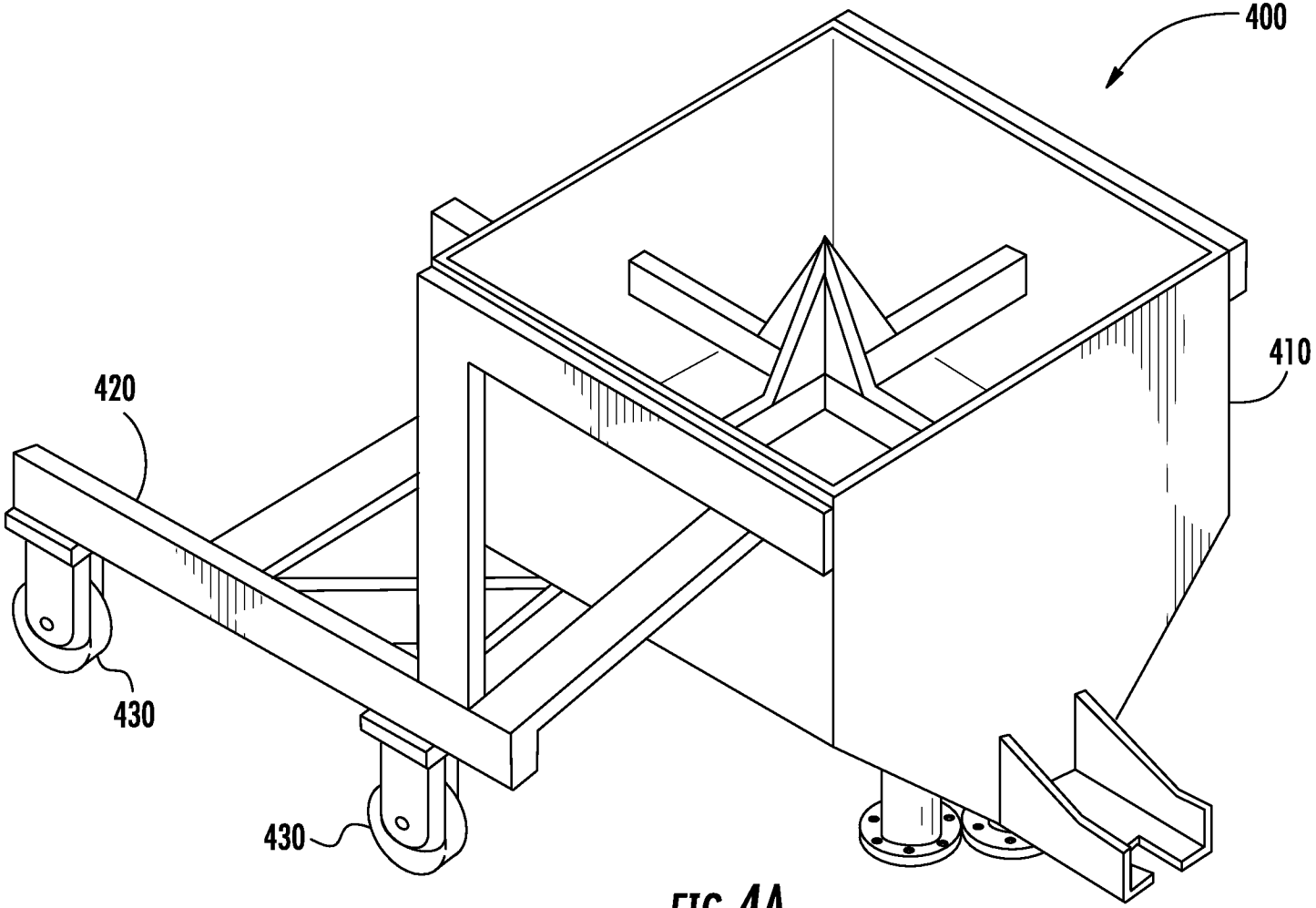
FIG. 4*a* is a perspective view of the hopper assembly of the sanding hopper system, in accordance with one embodiment of the invention.
Figure 4B:
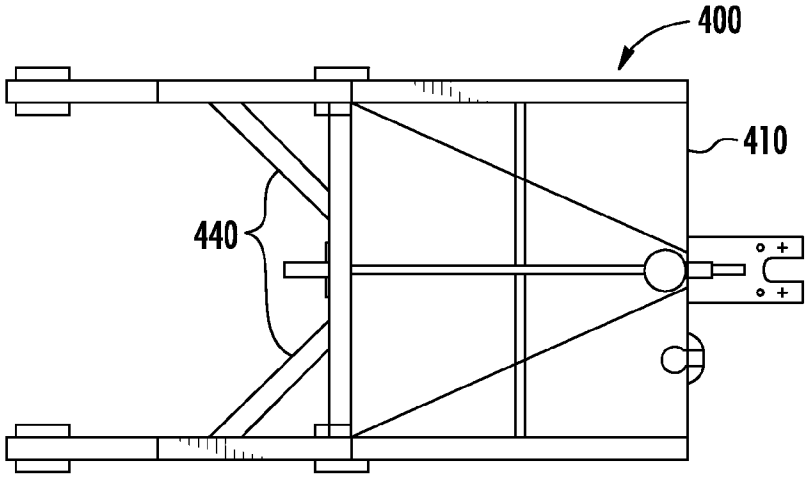
FIG. 4*b* is a top view of the hopper assembly of the sanding hopper system, in accordance with one embodiment of the invention.
Figure 4D:
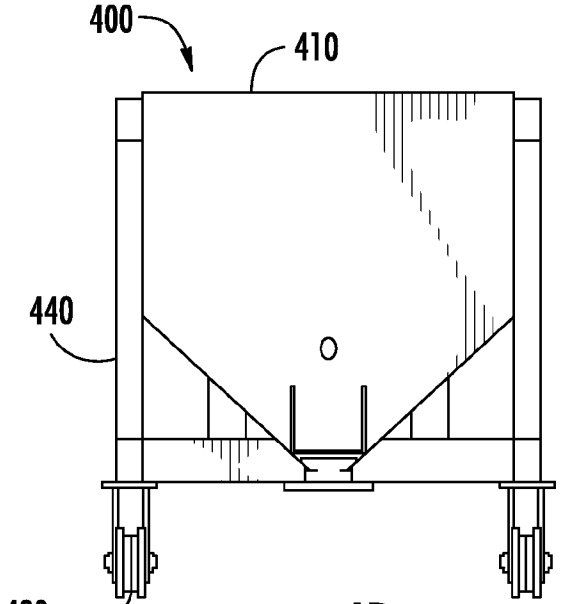
FIG. 4*d* is a front view of the hopper assembly of the sanding hopper system, in accordance with one embodiment of the invention.
Figure 4C:
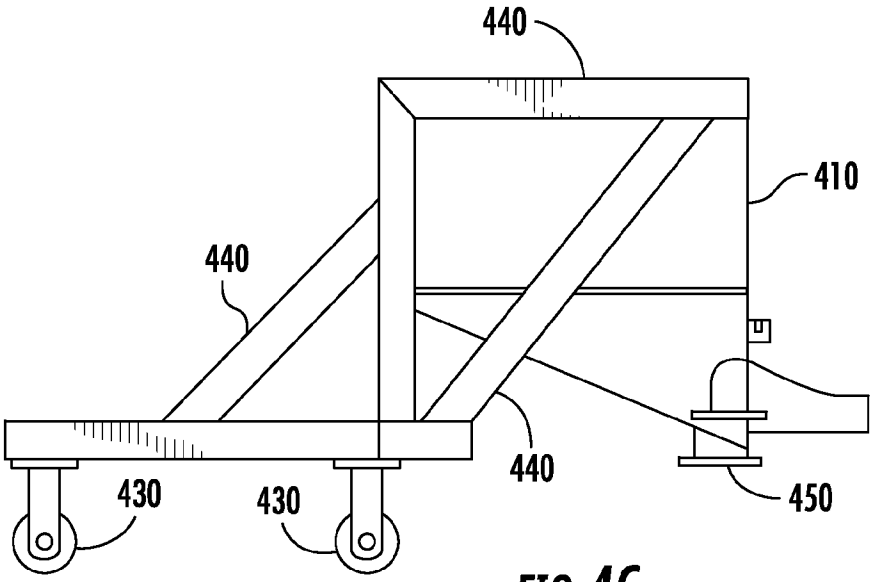
FIG. 4*c* is a side view of the hopper assembly of the sanding hopper system, in accordance with one embodiment of the invention.

FIGS. 2-10 illustrate embodiments of the automatic sanding hopper system 100, and the various components thereof. The automatic sanding hopper system 100 at least partially automates a sanding process 1 for supplying sand to a tap hole 730 in the furnace between the heats of manufacturing various steel products. As illustrated in FIGS. 2-6*d* the automatic sanding hopper system 100 comprises a hopper support structure 200, a furnace shell 700, a sump plate 720, a hopper assembly 400, a hopper rail assembly 500, and a chimney assembly 600. The various assemblies, and components thereof, of the automatic sanding hopper system 100 of FIG. 2 are illustrated in FIGS. 3*a*-6*d* and described in further detail throughout this specification. In general, the hopper assembly 400 is located on the hopper support structure 200, and may move along the hopper rail assembly 500 to various positions over the chimney assembly 600. The chimney assembly 600 is supported on the sump plate 720, which is supported by the furnace shell 700. The hopper assembly 400 is generally configured to first clear out the chimney hole 620 in the chimney assembly 600 in order to deliver sand to the tap hole 730 in the furnace (further illustrated below in FIGS. 7-10). In some embodiments of the invention the hopper assembly 400 may include a sensor device to determine if the sand has been properly supplied to the tap hole 730 in the furnace.

Sand is usually supplied to the tap hole 730 in the furnace using a manual process, in which a user physically opens the chimney door, clears out any unwanted build-up of steel by-products (e.g., solidified steel and slag) in the chimney hole 620, and manually pours buckets of sand, filled at the hopper, through the chimney hole 620 into the tap hole 730. The manual process may be dangerous to the person tasked with filling the tap hole 730 because the person pouring sand into the tap hole 730 is exposed to a hostile environment. As the tap hole 730 is filled with sand, between the steelmaking heats, the furnace is still running at approximately 3000° F. (or more or less). A person delivering sand through the chimney and into the tap hole 730 may be susceptible to injury from the hot furnace, from steam created from water leaks in the cooling system, and from toxic gases if the person's respirator is not functioning properly.

Figure 1:
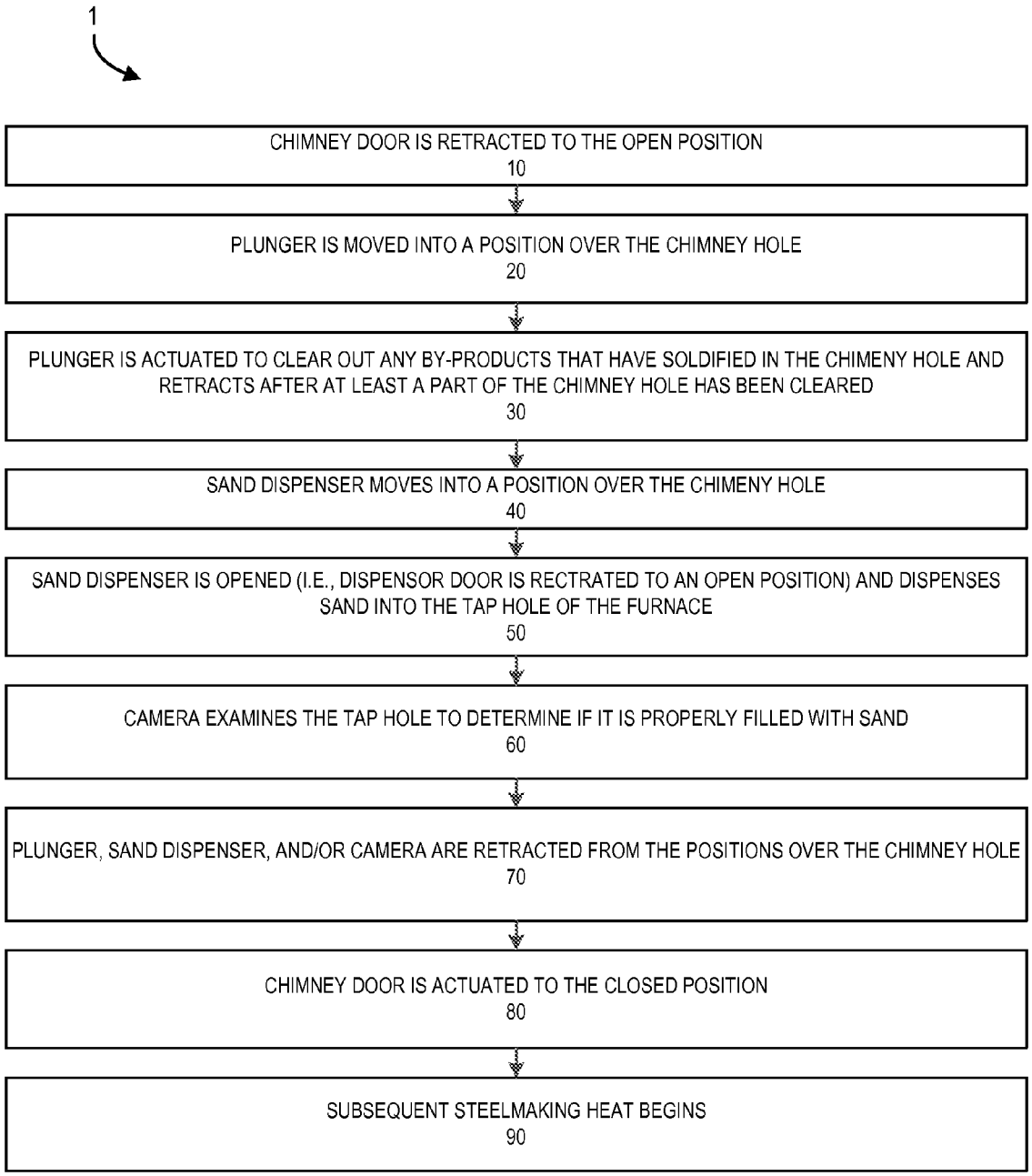
FIG. 1 is an sand delivery process for supplying sand to a tap hole of a furnace during a steelmaking process, in accordance with one embodiment of the invention.

FIG. 1 illustrates a sanding process 1 for utilizing a sanding hopper system 100 that does not require a human to deliver sand from the hopper to the tap hole 730, or thus, otherwise reduces human interaction in the sanding process, in accordance with an embodiment of the present invention. During operation of the furnace the hopper assembly 400 is positioned in the retracted home position, as illustrated in FIG. 2. Furthermore, unlike the open position of the chimney door 610 illustrated in FIG. 2, during operation of the furnace the chimney door 610 of the chimney assembly 600 would be in the closed position. After the steel is melted, at least partially refined (e.g., additional refining will most likely occur after the furnace stage), and at the target tapping temperature (e.g., generally around 3000° F.), the furnace is positive tilted, as further illustrated below with respect to FIG. 8. While in the positive tilted position the tap hole gate 750 is moved to the open position, at least some sand in the tap hole 730 falls out of the tap hole 730, and the molten steel is poured out of the furnace and into ladles through the tap hole 730. The sand still located in the tap hole 730 (and any that has fallen into the ladle) is totally consumed as the molten steel is poured into the ladle. After the molten steel is poured out of the furnace, the furnace is moved to the negative tilt position and the process of setting up the furnace for the next heat begins, as further illustrated in FIG. 9. During set-up of the furnace, the tap hole gate 750 is closed and the tap hole 730 of the furnace is filled with sand. The sand is delivered to the tap hole 730 before the furnace is returned to its level operating position from the negative tilt position. After the furnace is returned to level operating position, the electrode (not illustrated) is raised to a top position (e.g., the electrode is move in and out of the furnace to melt the scrap steel, as necessary). Thereafter, the furnace roof is removed or opened in order to prepare to deliver the next charge to the furnace. In some embodiments, before the charged is delivered the furnace lining is inspected for damage, and repairs may be made to the furnace lining, hearth, slag-line, tap hole 730, and/or spout, etc. of the furnace, if necessary.

As illustrated in FIG. 1 the sanding process 1 may begin by opening the chimney door 610, as illustrated by block 10. In some embodiments the chimney door 610 may be opened automatically through the use of a hydraulic actuating device that retracts the chimney door 610 from the chimney hole 620 along the chimney rails 612. In other embodiments of the invention the chimney door 610 may slide open on tracks, flip open on hinges, swing open into or out of the chimney hole 620 using a support member, or otherwise retract or open to a position that allows access to the chimney hole 620 through other like means.

As illustrated by block 20 in FIG. 1, a plunger 310 is moved into position (e.g., a first position, second position, etc. depending on the location of the plunger 310) over the chimney hole 620. As illustrated in FIG. 2, the plunger 310 may be operatively coupled to the hopper assembly 400, and thus, moved into position when the hopper assembly 400 moves along the rails 510 of the hopper rail assembly 500. The hopper assembly 400 may move from a retracted position to another position in which the plunger 310 is located over the chimney hole 620. In other embodiments of the invention, the plunger 310 may be moved to a position over the chimney hole 620 through the use of a swing arm that is independent from the hopper assembly 400, a support arm that is actuated independent of the hopper assembly 400, or otherwise moved to a position over the chimney hole 620. In some embodiments, when the plunger 310 is moved independently of the hopper assembly 400, the plunger 310 may be moved through the use of pneumatic, hydraulic, electric, etc. actuation. In some embodiments of the invention a sensor device (e.g., a camera 320, or other device) may be used to determine if any solidified remnants of the steelmaking process have obstructed the chimney hole before, during, or after moving the plunger 310 into a position over the chimney hole 620. The operation of the camera 320 (or other image capture device), or other sensor device, is described in further detail below.

As illustrated by block 30 in FIG. 1, after the plunger 310 is located over the chimney hole 620, the plunger 310 actuates from its retracted position into at least a portion of the chimney hole 620 in order to clear out any by-products (e.g., solidified steel, slag build-up, etc.) that have accumulated in the chimney hole 620. In some embodiments of the invention, the end of the plunger 310 may comprise a plug 312, which may help to clear out the by-products from the chimney hole 620. The plug 312 may comprise ribs, projections, etc. which may help to clear out the by-products from the chimney hole 620. In some embodiments of the invention, the plunger 310 and/or the plug 312 may rotate after or during actuation of the plunger 310 to help clear out the chimney hole 620 (e.g., rotate along the center line of the plunger 310 or outside of the centerline of the plunger 310). The plunger 310 may be actuated through the use of a plunger rod 314 that is extended using a pneumatic cylinder 316. In other embodiments of the invention, the plunger 310 may be extended through the use of a hydraulic device that actuates the plunger 310 into at least a portion of the chimney hole 620. After the plunger 310 at least partially cleans out the chimney hole 620, the plunger 310 is retracted from the chimney hole 620.

Once the chimney hole 620 is at least partially cleaned out, in some embodiments, the sand dispenser 450 is moved into a position (e.g., a first position, second position, etc. depending on the location of the sand dispenser 450) over the chimney hole 620, as illustrated by block 40 of FIG. 1. As previously explained with respect to the plunger 310, the sand dispenser 450 may be operatively coupled to the hopper assembly 400, such that the hopper assembly 400 may move to a position (e.g., not the retracted position or the position in which the plunger 310 is located over the chimney hole 620) to locate the sand dispenser 450 over the chimney hole 620. For example, the sand dispenser may be moved into position when the hopper assembly 400 moves along the rails 510 of the hopper rail assembly 500. Again, as discussed with respect to the plunger 310, in some embodiments of the invention, the sand dispenser 450 may be moved to a position over the chimney hole 620 through the use of a swing arm that is moved independent of the hopper assembly 400, through the use of a support arm actuated independent of the hopper assembly 400, or otherwise moved to a position over the chimney hole 620. In some embodiments, when the sand dispenser 450 is moved independently of the hopper assembly 400, the sand dispenser 450 may be moved through the use of a pneumatic, hydraulic, electric, etc. actuation.

As illustrated by block 50, when the sand dispenser 450 is in position over the chimney hole 620, sand is released such that the sand passes through the chimney hole 620, into the furnace, and into the tap hole 730 in order to prepare the furnace for the next steelmaking heat. In some embodiments of the invention the sand dispenser 450 may comprise an actuating member that opens and closes a hopper door such that a hopper hole located near the bottom of the hopper 410 dispenses sand from the hopper 410 into the tap hole 730. In other embodiments the sand dispenser 450 may comprise a tube that can be positioned over or in the chimney hole 620, a plug that may be opened to allow for sand to drop into the tap hole 730, a tap that may be opened, or other like means for dispensing sand from the hopper 400, through the chimney hole 620, and into the tap hole 730. In some embodiments of the invention, the sand dispenser 450 may be opened and closed through the use of a pneumatic, hydraulic, electric, etc. means. The sand dispenser 450 may be automatically opened for a set amount of time to fill the tap hole 730. Alternatively, in other embodiments, the sand dispenser 450 may be opened and closed automatically through the use of a switch, button, or other electronic signal, as determined by a person.

Block 60 illustrates that in some embodiments a camera 320 (or other type of image capture device) is operatively coupled to the hopper assembly 400, such that the camera 320 may be positioned over the chimney hole 620 in order to capture a view of the tap hole 730 in the furnace and allow a user to determine if the tap hole 730 is properly filled with sand (or cleared of debris before filling the tap hole 730 with sand). In other embodiments of the invention the camera 320 may be operatively coupled directly to the sand dispenser 450, to the plunger 310, and/or may be positionable independently of the hopper assembly 400. In some embodiments, the camera 320 provides a view of the tap hole 730 when the sand dispenser 450 is located over the chimney hole 620 (e.g., a first position, second position, etc. depending on the location of the sand dispenser 450). In some embodiments of the invention the camera 320 may provide a view of the tap hole 730 and/or the chimney hole 620 when the plunger 310 is located over the chimney hole 620 (e.g., a first position, second position, etc. depending on the location of the plunger 310 and/or camera 320). In other embodiments the camera 320 is operatively coupled to the hopper assembly 400 (e.g., located directly on the hopper 410, hopper support rails 420, the plunger 310, the sand dispenser 450, or other like position) such that the camera 450 is positioned to provide a view of the tap hole 730 by moving the hopper assembly 400 along the hopper rail assembly 500. In still other embodiments, the camera 320 may be operatively coupled to the hopper assembly 400 in a way that allows the camera 320 to move independently of the hopper assembly 400, the plunger 310, and/or the sand dispenser 450, etc. In some embodiments of the invention the camera 320 may be another type of sensor device, that allows a user to view the chimney hole 620 or tap hole 730, or otherwise allows for a determination that the chimney hole 620 has been sufficiently cleared of by-product build-up, the tap hole 730 is sufficiently clear of by-product build-up, or that the tap hole 730 is properly filled with sand.

If a user determines that the tap hole 730 has been properly filled with sand through the use of the camera 320, by manually looking through the chimney hole 620, inspecting the furnace tap hole 730 from below, or other like method of determining that the tap hole 730 is filled with sand, one or more of the plunger 310, sand dispenser 450, and/or the camera 320 (or other sensor device), is retracted from the positions over the chimney hole 620, as illustrated by block 70 in FIG. 1. In some embodiments of the invention one or more of the plunger 310, camera 320, or sand dispenser 450 may be moved to, or away from, a position over the chimney hole 620 at the same time. In some embodiments the plunger 310, sand dispenser 450, and/or the camera 320 are retracted from positions over the chimney hole 620 by retracting the hopper assembly 400, through the use of a hopper transport component (e.g., wheels 430, rollers, a track, chain and gears, etc.) located on the hopper structure 440, along the hopper rail assembly 500, which is discussed in further detail later.

After the plunger 310, sand dispenser 450, and/or the camera 320, are retracted from the positions over the chimney hole 620, the chimney door 610 is actuated to the closed position, as illustrated by block 80 in FIG. 1. In some embodiments of the invention the chimney door 610 may be actuated to the closed position as the plunger 310, sand dispenser 450, and/or the camera 320 are retracted from the positions over the chimney hole 620. As previously discussed, the chimney door 610 may be automatically closed through the use of pneumatic pressure that that is activated by an electrical signal, wireless signal, or other like actuation means.

As illustrated by block 90 of FIG. 1, the subsequent steelmaking heat may begin after the chimney door 610 is closed.

FIGS. 2 through 10 illustrate various embodiments of the automatic sanding hopper system 100 in accordance with various embodiments of the invention. As illustrated in FIGS. 2, 3*a*, and 3*b*, the hopper assembly 400 is configured to translate along the hopper rail assembly 500 to various positions, in order to locate the plunger 310, the camera 320, and/or the sand dispenser 450 over the chimney hole 620 for properly filling the tap hole 730 of the furnace. The furnace, in the installed position, would be at least partially located within the cavity 710 created by the furnace shell 700 and the sump plate 720.

The hopper assembly 400 is illustrated in FIGS. 4*a*-4*d*. As illustrated in the FIGS. 4*a*-4*d* the hopper assembly 400 is generally comprised of a hopper 410, which is used to hold sand for filling the tap hole 730 with sand between steelmaking heats. The hopper 410 in some embodiments holds approximately forty-five hundred (4500) pounds of tap hole sand, which typically lasts about the length of one shift (e.g. eight hours) when running the furnace at full capacity. In other embodiments of the invention other sizes of hoppers 410 may be utilized to store various amounts of sand. The hopper 410 may be supported within a hopper structure 440. The hopper structure 440 may comprise members operatively coupled together to provide support for the hopper 410. The members may be welded, bolted, riveted, or otherwise secured together. In some embodiments of the invention, the hopper structure 440 may be a cast structure, molded structure, or any other like structure that supports a hopper 410 and allows the hopper assembly 400 to be positioned in various locations. The hopper assembly 400 may also comprise hopper support rails 420 with wheels 430, which may be solid wheels or grooved to align with the rails 510 of the rail assembly 500, as described in further detail below. The hopper assembly 400 may also comprise a hopper drive 460 that moves the hopper assembly 400 to various positions, as previously described, through the use of the rails 510 of the hopper rail assembly 500 and the wheels 430 of the hopper assembly 400. The hopper drive 460 may be a hydraulic actuating device. In some embodiments of the inventions the hopper drive 460 may be an electric motor, a pneumatic device, a hydraulic device, or the like device that turns gears and a chain, actuates a rod, uses a pulley and wire system, or uses another like system to position the hopper assembly 400 as required.

Figure 5A:
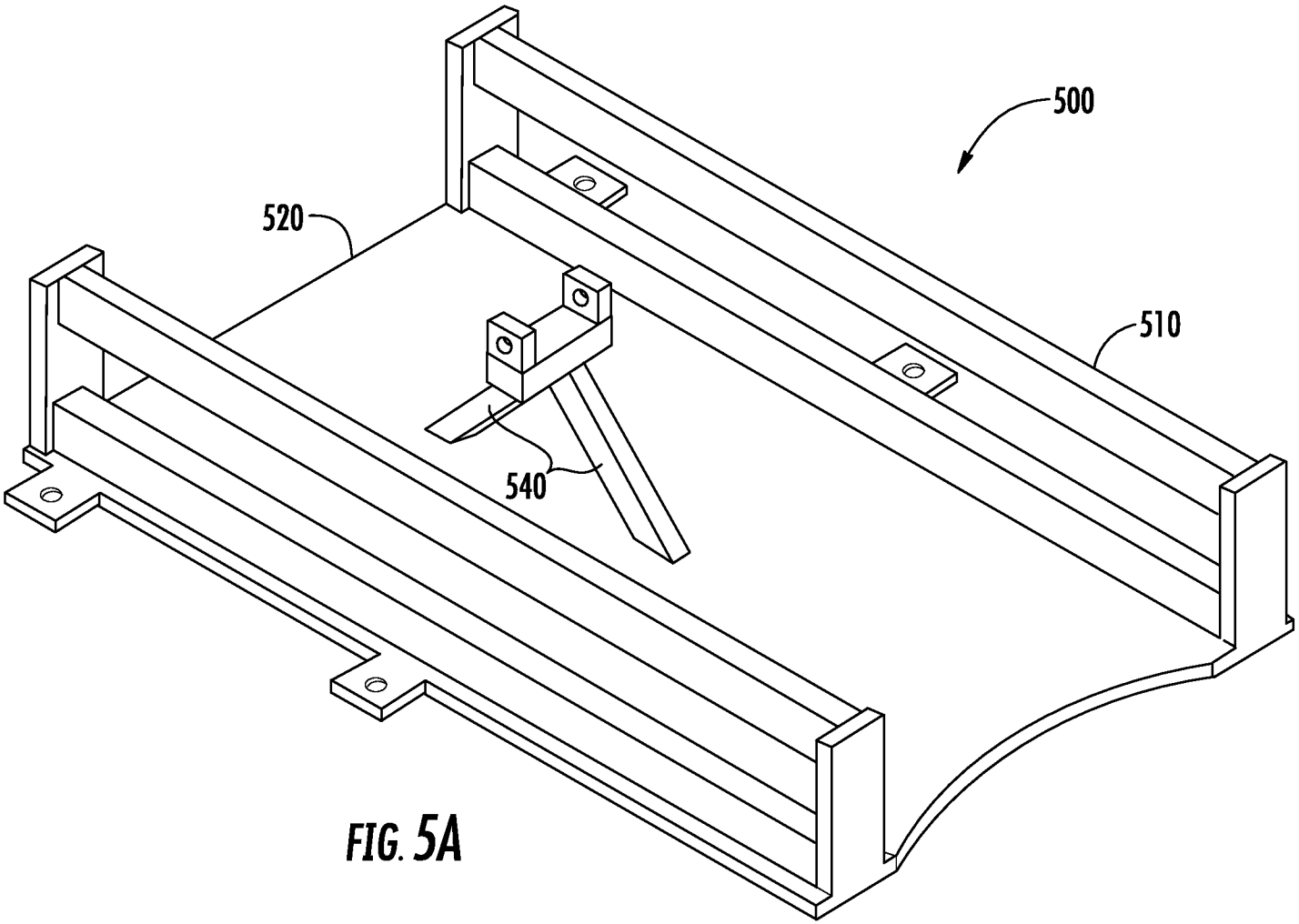
FIG. 5*a* is a perspective view of the hopper rail assembly of the sanding hopper system, in accordance with an embodiment of the invention.
Figure 5D:
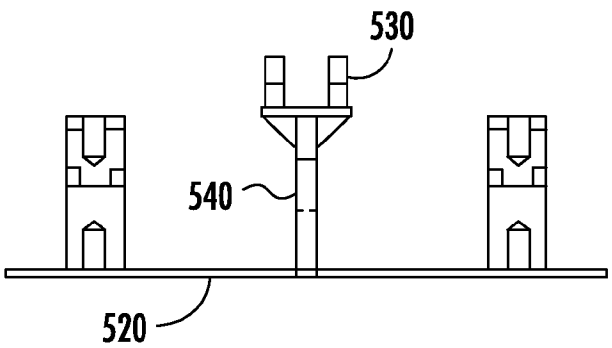
FIG. 5*d* is a front view of the hopper rail assembly of the sanding hopper system, in accordance with an embodiment of the invention.
Figure 5C:
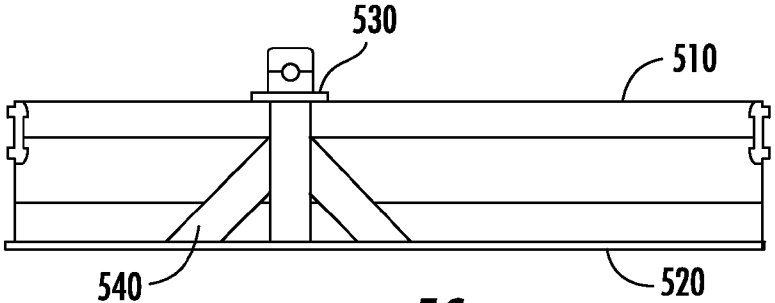
FIG. 5*c* is a side view of the hopper rail assembly of the sanding hopper system, in accordance with an embodiment of the invention.
Figure 5B:
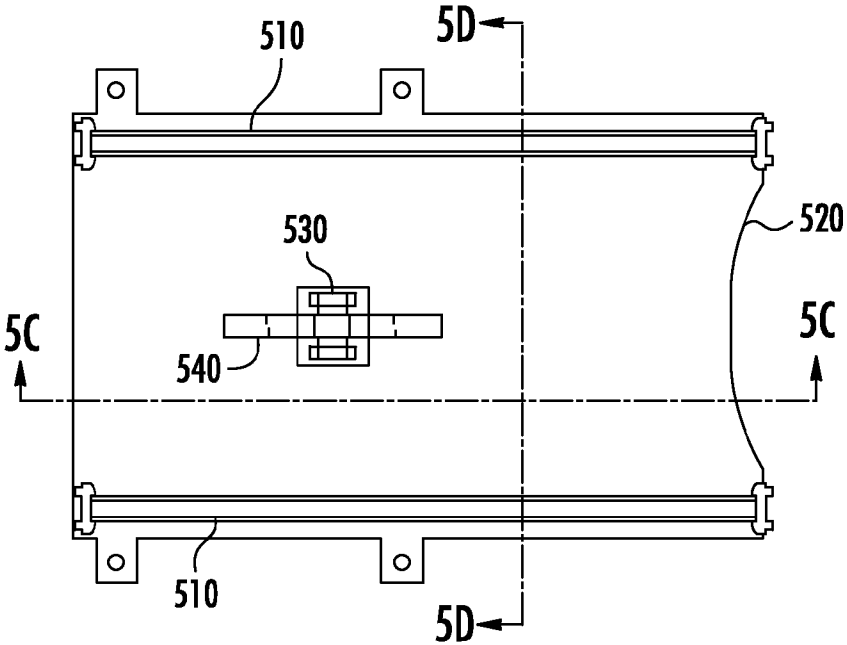
FIG. 5*b* is a top view of the hopper rail assembly of the sanding hopper system, in accordance with an embodiment of the invention.
Figure 6B:
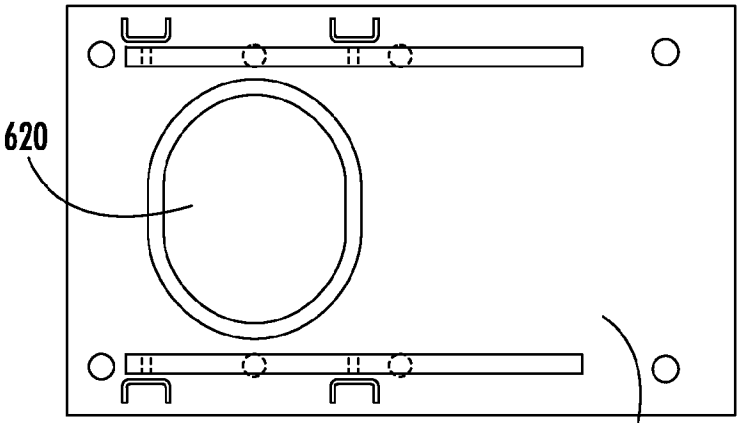
FIG. 6*b* is a top view of the chimney assembly of the sanding hopper system, in accordance with an embodiment of the invention.
Figure 6D:
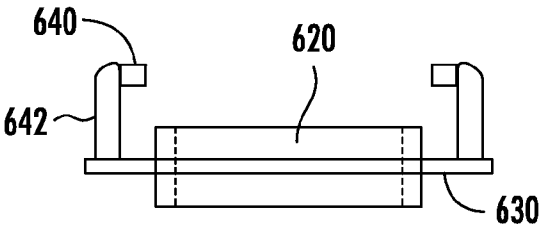
FIG. 6*d* is a front view of the chimney assembly of the sanding hopper system, in accordance with an embodiment of the invention.
Figure 6A:
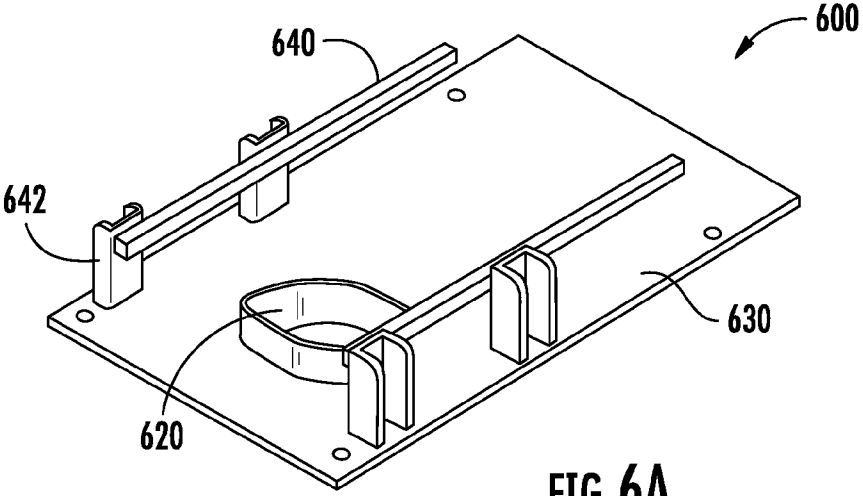
FIG. 6*a* is a perspective view of the chimney assembly of the sanding hopper system, in accordance with an embodiment of the invention.
Figure 6C:
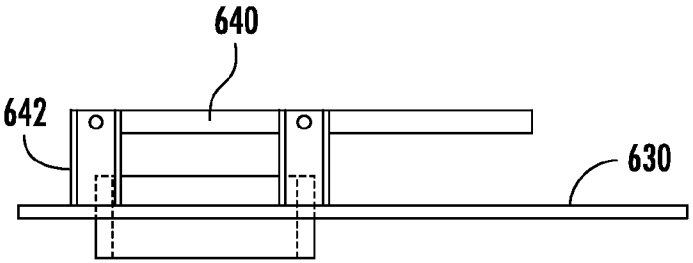
FIG. 6*c* is a side view of the chimney assembly of the sanding hopper system, in accordance with an embodiment of the invention.

FIGS. 5*a* through 5*d* illustrate the hopper rail assembly 500 in accordance with one embodiment of the invention. As illustrated in FIGS. 5*a* through 5*b* the hopper rail assembly 500 comprises rails 510, a base plate 520, a trunnion block 530, and trunnion supports 540. As illustrated in FIG. 2 the base plate 520 is operatively coupled to the hopper support structure 200. The rails 510 are operatively coupled to the base plate 520. The trunnion block 530 is also coupled to the base plate 520 through the use of the trunnion supports 540. In some embodiments, the wheels 430 ride on the rails 510. In other embodiments of the invention, the rails 510 secure the wheels 430 of the hopper assembly 400. Regardless of the configuration, the hopper assembly 400 may slide with respect to the rail assembly 500 through the use of the coupling of the wheels 430 to the rails 510. The trunnion block 530 supports the drive system 460 of the hopper assembly 400. The trunnion block 530 keeps the drive system 460 in place, while the drive system 460 is used to position the hopper assembly 400 in the required positions. As previously discussed, the hopper drive 460 may comprise gears and a chain, a pneumatic system that actuates a rod, a pulley and wire system, or another like system that allows the drive system to move the hopper assembly 400 along the rails 510 into the desired position for the plunger 310, the camera 320, and/or the sand dispenser 450.

FIGS. 6*a* through 6*d* illustrate the chimney assembly 600. As illustrated by FIG. 6 the chimney assembly comprises a chimney door 610, a chimney hole 620, a chimney baseplate 630, chimney rails 640, chimney rail supports 642, chimney door drive 650, etc. The chimney assembly 600 may also comprise a door transport component (e.g., rollers 612, wheels, a track, chain and gears, etc.) on the chimney door 610 where the chimney door 610 interacts with the rails 640 to allow the chimney door 610 to slide with respect to rails 640 in a retracted open position or in an extended closed position for opening or closing the chimney hole 620 (e.g., opening of various sizes and shapes). The chimney door drive 650 may comprise a pneumatic system that opens and closes the chimney door 610 by allowing the rollers 612 to move with respect to the rails 640. In some embodiments of the invention, the chimney door drive 650 may comprise of an electric motor, hydraulic system, pneumatic system, or other like system that allows the chimney door 610 to slide open on a rail, flip open on a hinge, open using a support member, or utilizes another like system to open and close the chimney hole 620.

Figure 7:
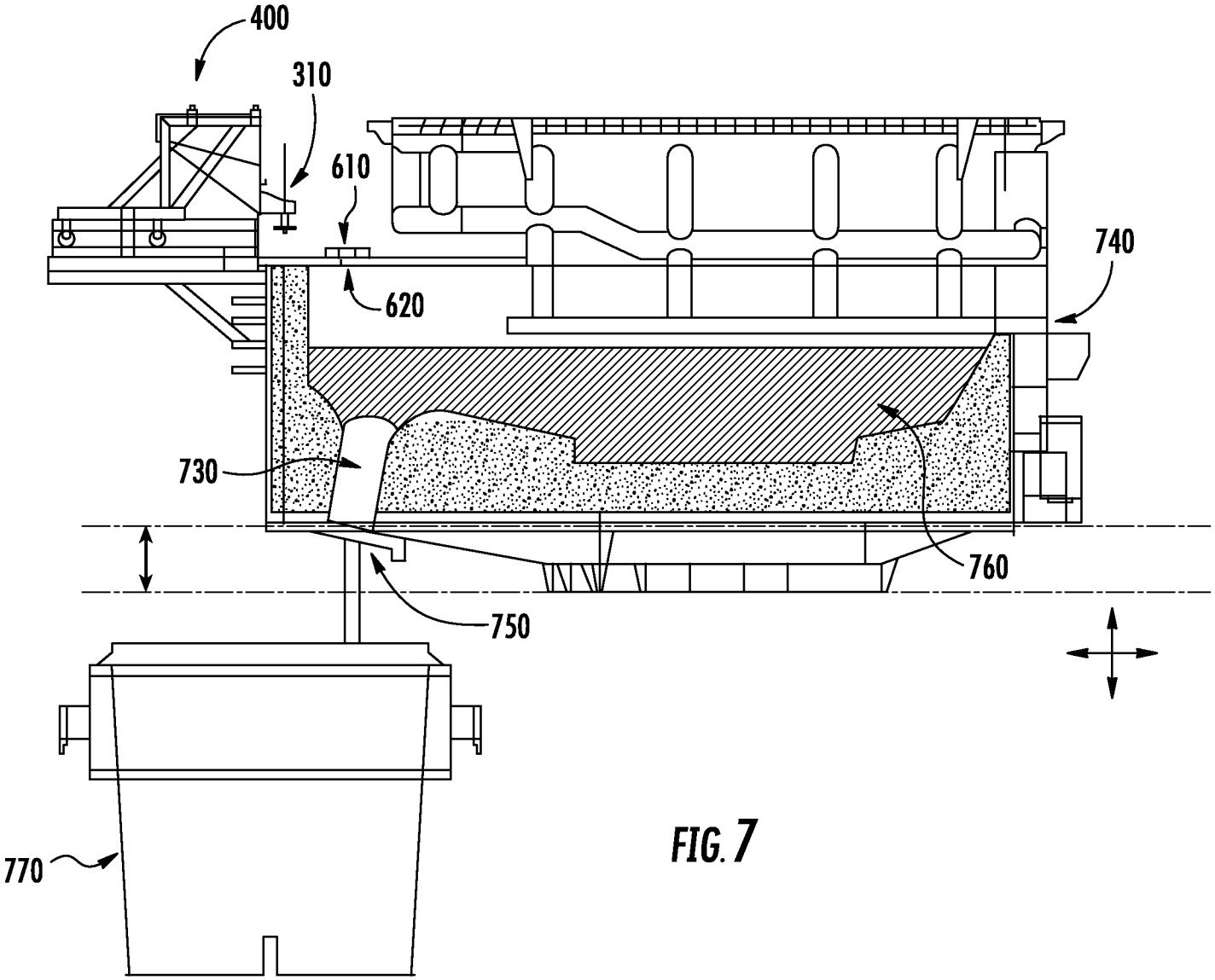
FIG. 7 is a side view of the sanding hopper system associated with a furnace, in accordance with an embodiment of the invention.

FIGS. 7 thought 10 illustrate the sanding hopper system associated with a furnace. FIG. 7 illustrates the sanding hopper system associated with a furnace during operation of the furnace. As discussed above, during operation of the furnace 740 the chimney assembly including the chimney door 610 may be closed such that there is no access to the chimney hole 620. Furthermore, during operation of the furnace 740 the hopper assembly 400 may be moved away from the chimney hole 620 and operating furnace 740. The operation of the furnace 740 allows the steel 760 in the furnace 740 to be melted and at least partially refined prior to being poured into ladles 770 through the tap hole 730. During operation of the furnace 740 the tap hole gate 750 associated with the tap hole 730 is closed to prevent any molten steel from prematurely flowing to a ladle 770

Figure 8:
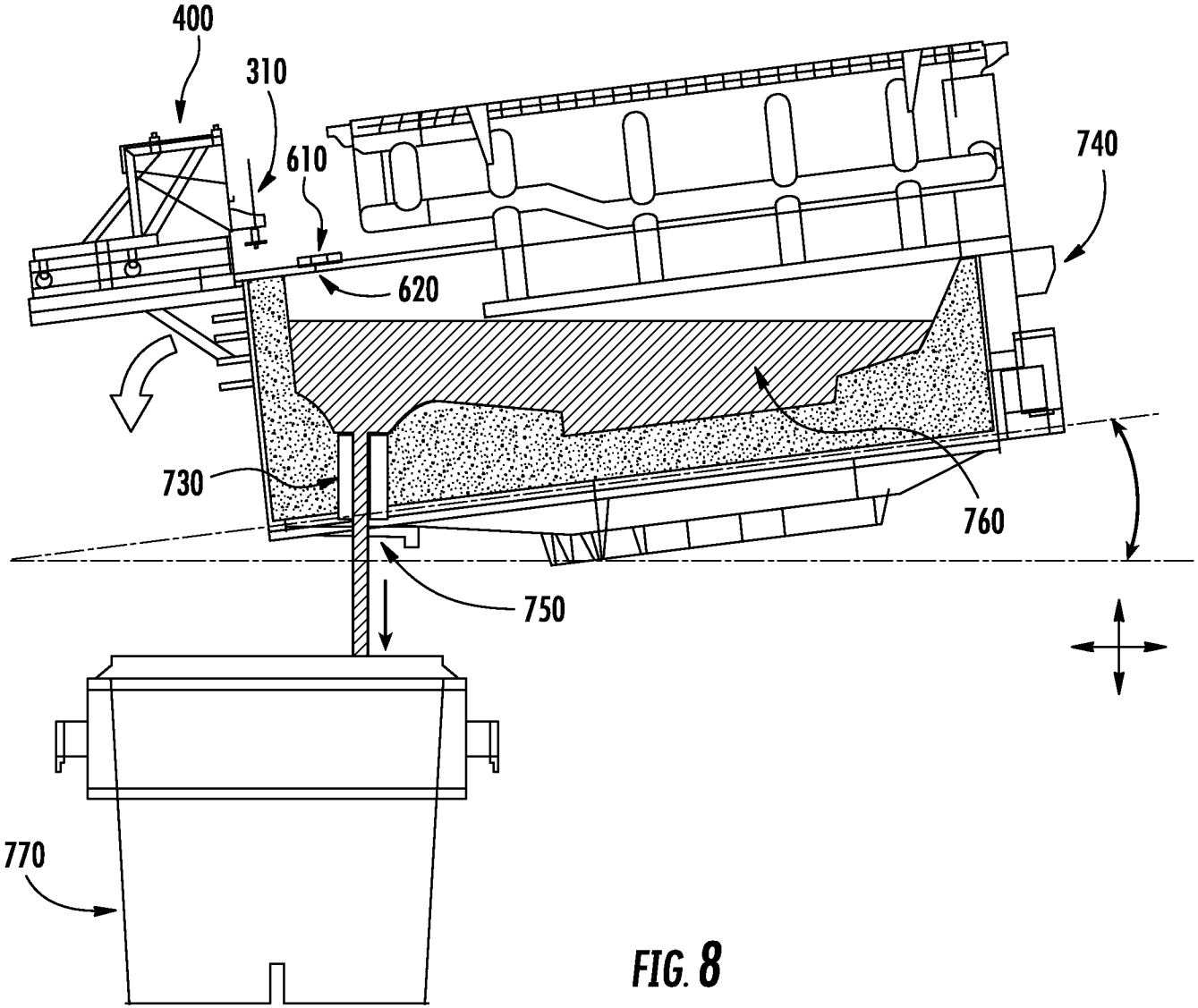
FIG. 8 is a side view of the sanding hopper system associated with a positively tilted furnace, in accordance with an embodiment of the invention.

As illustrated in FIG. 8, after the steel 760 has melted and at least been partially refined during the operation of the furnace 740 a target tapping temperature may be reached. The target tapping temperature may be generally around 3000° F. Upon the target tapping temperature being reached the furnace 740 is positively tilted. When the furnace 740 is positively tilted the tap hole gate 750 may be opened to allow the molten steel 760 to flow from the furnace 740 to a ladle 770, and thus, consume the sand in the tap hole 730. At least some of the sand that is in the tap hole 730 when the tap hole gate 750 is opened may fall into the ladle 770, and may also be completely consumed by the molten steel 760 flowing into the ladle 770.

Figure 9:
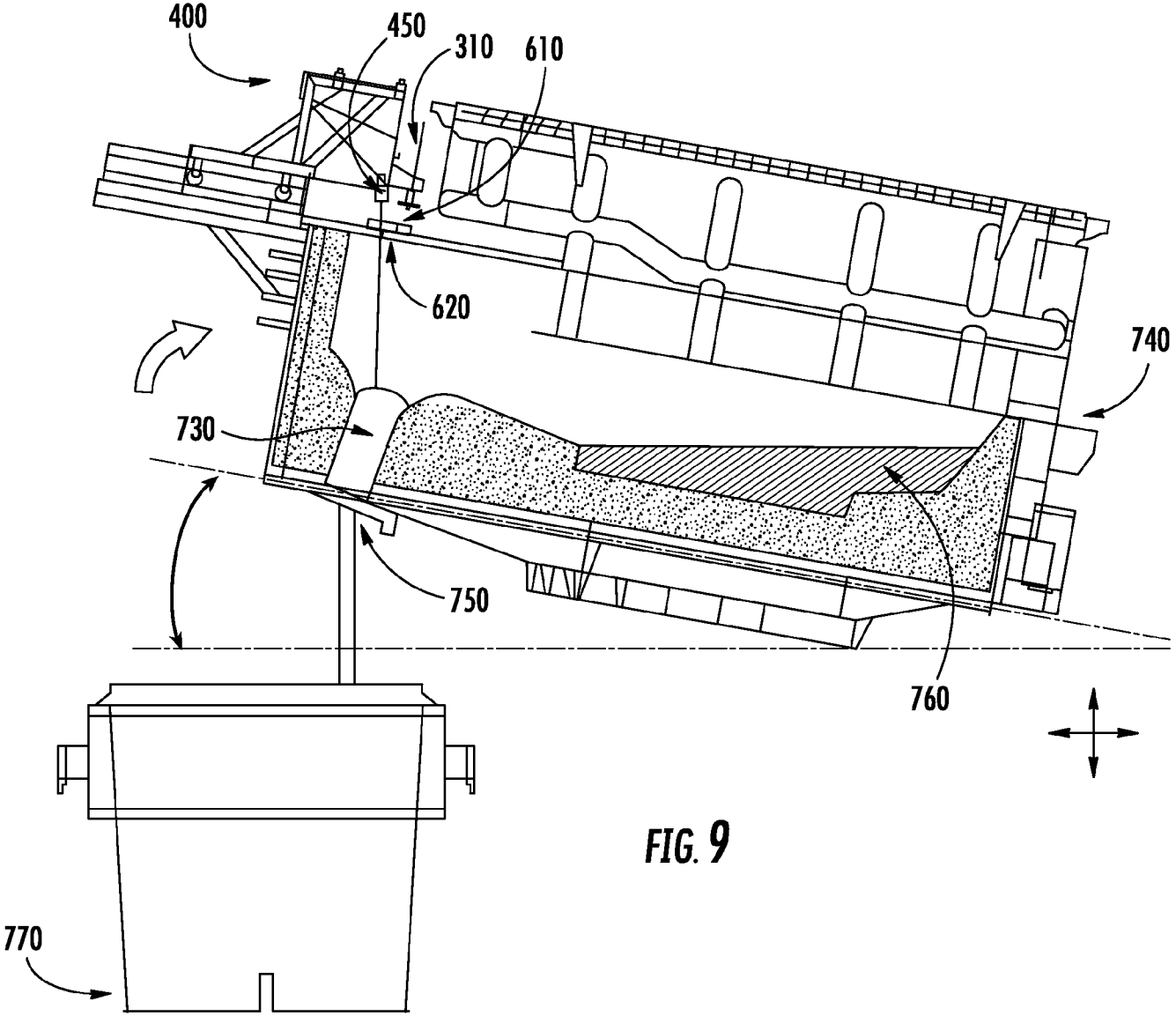
FIG. 9 is a side view of the sanding hopper system associated with a negatively tilted furnace, in accordance with an embodiment of the invention.
Figure 10:
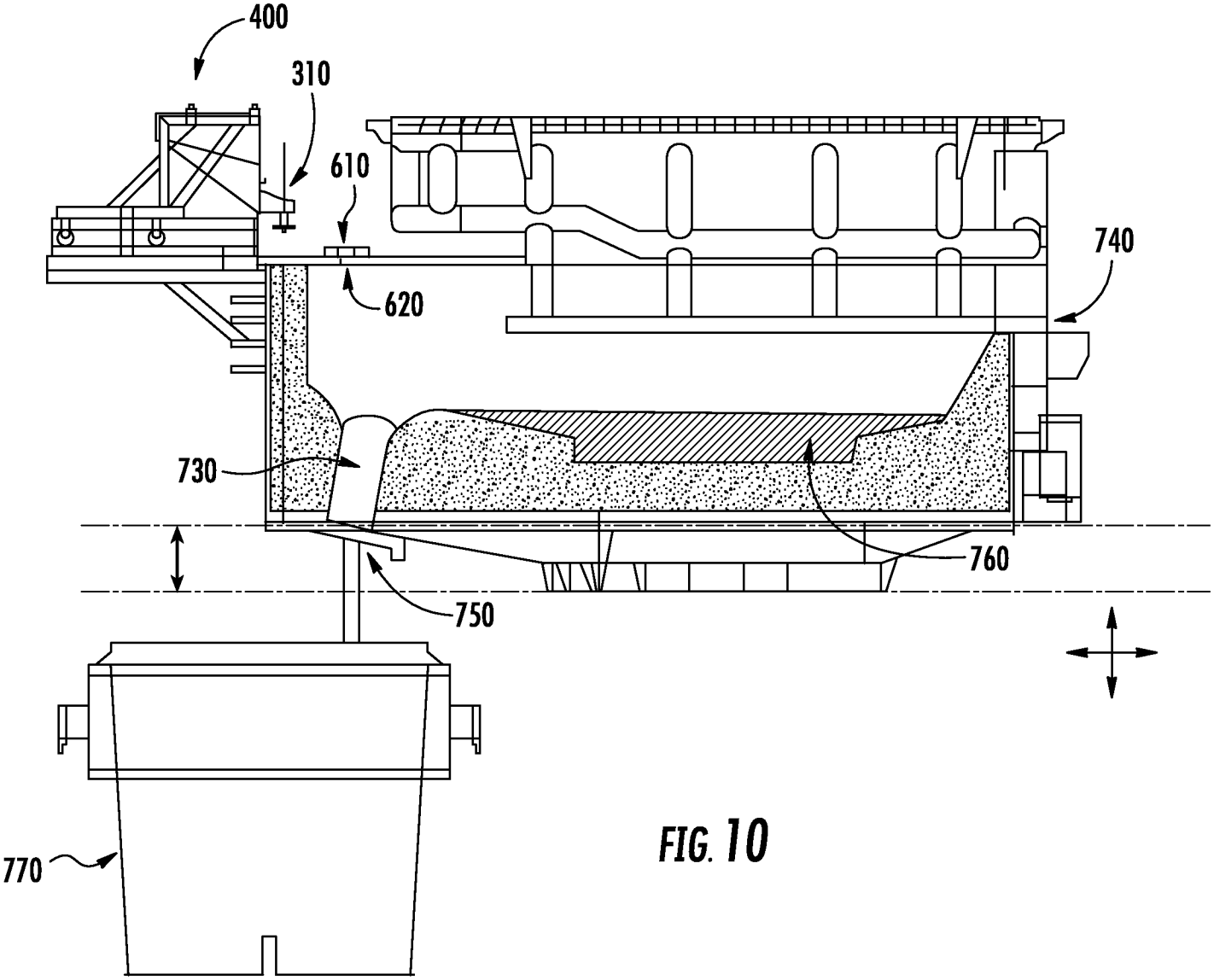
FIG. 10 is a side view of the sanding hopper system associated with a furnace, in accordance with an embodiment of the invention.

Next, as illustrated in FIG. 9, after the molten steel 760 has poured out of the furnace 740 into the ladle 770, the furnace 740 may be moved to a negative tilt position. In this way, the molten steel 760 remaining in the furnace 740 may be tilted away from the tap hole 730. The negatively tilted furnace 740 initiates the steps of setting up the furnace 740 for the next heat to begin. During the set up process, the tap hole gate 250 is closed such that the tap hole 730 may be filled with sand. The sand hopper assembly 400 may be moved into position over the chimney hole 620. The chimney door 610 may be opened to allow the sand dispenser 450 to dispense sand into the tap hole 730 (e.g., after the chimney hole is cleared). Upon filling the tap hole 730 with sand, the hopper assembly 400 may retract from its position over the chimney hole 620 and the furnace 740 is moved back into its level operating position, as illustrated in FIG. 10.

FIGS. 7 through 10 illustrate that the sanding hopper system 100, including the hopper assembly 400 is tilted between the neutral, positive, and negative positions along with the furnace 740. In some embodiments of the invention the sanding hopper system 100 and/or the hopper assembly 400 does not tilt along with the furnace, such that as the furnace 740 is tilted between the neutral, positive, and negative positions the sanding hopper system 100 and/or the hopper assembly 400 stays in a generally horizontal position.

The systems that move the various components described herein have been generally disclosed as pneumatic devices that actuate members, turn gears, push or pull the components using rails and rollers, etc. It should be understood that any other types of positioning devices may be utilized to move the chimney door 610 or hopper assembly 400, and also, the plunger 310, the camera 320, and/or the sand dispenser 450 into the proper location over the chimney hole 620.

Furthermore, it has been discussed that the chimney door 610, plunger 310, camera 320, sand dispenser 450, and/or hopper assembly 400 may be moved, actuated, positioned, etc. over the chimney hole 620 at various positions. It should be understood that the chimney door 610, plunger 310, camera 320, and/or sand dispenser 450 may be operatively coupled to the hopper assembly 400 in various positional orders (e.g., farthest, second farthest, closest to the hopper assembly 400). Furthermore, the plunger 310, camera 320, and/or sand dispenser 450 may move with the movement of the hopper assembly 400 and/or move independently of the movement of the hopper assembly 400. Therefore, in some embodiments of the invention the plunger 310, camera 320, and/or sand dispenser 450 may be coupled to the hopper assembly 400, and thus, may move with respect to the hopper assembly 400 and also move without movement of the hopper assembly 400. Furthermore, in some embodiments of the invention these components may be actuated automatically through the use of a computer program without human input, actuated automatically through the use of a human controlling a computer program, switch, button, or other like signal, or actuated automatically through the use of sensors (e.g., temperature, accelerometers, gyroscopes, visual, or any other like sensor) to detect when it is the proper time to open the chimney door 610, position the hopper assembly 400, actuate the plunger 310, re-position the hopper assembly 400, open and the close the sand dispenser 450, close the chimney door 610, etc.

Specific embodiments of the invention are described herein. Many modifications and other embodiments of the invention set forth herein will come to mind to one skilled in the art to which the invention pertains, having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A sanding hopper system, comprising:

a hopper support structure;

at least one rail operatively coupled to the hopper support structure;

a hopper assembly comprising a hopper and a hopper transport component, wherein the hopper transport component is operatively coupled to the at least one rail, wherein the hopper assembly is configured to move between at least a retracted position and a sand dispensing position over a chimney hole in the furnace through the relative movement of the hopper transport component with respect to the at least one rail, and wherein the hopper of the hopper assembly is configured to hold sand;

a plunger, wherein the plunger is configured for removable positioning over the chimney hole for removing steelmaking by-products from the chimney hole; and a sand dispenser operatively coupled to the hopper assembly, wherein the sand dispenser is configured for removable positioning over the chimney hole, and when the hopper assembly is in the sand dispensing position for supplying sand to a tap hole in the furnace between steelmaking heats.

2. The sanding hopper system of claim 1, wherein the plunger is operatively coupled to the hopper assembly, and wherein the plunger is configured for removable positioning over the chimney hole by moving the hopper assembly into a plunger position different from a the retracted position and the sand dispensing system.

3. The sanding hopper system of claim 1, wherein the plunger is configured for removing steelmaking by-products from the chimney hole by actuating the plunger into at least a portion of the chimney hole; and thereafter retracting the plunger from the chimney hole.

4. The sanding hopper system of claim 3, wherein the plunger further comprises one or more projections, may rotate along the center line of the plunger, or may rotate outside of the centerline of the plunger for clearing by-products from the chimney hole.

5. The sanding hopper system of claim 1, further comprising a chimney assembly, wherein the chimney assembly comprises a chimney door and the chimney hole for accessing a furnace in a steelmaking facility, and wherein the chimney door is configured for automatically opening and closing the chimney hole for access to the furnace.

6. The sanding hopper system of claim 1, wherein the sand dispenser is opened to allow the sand from the hopper to enter the tap hole in the furnace; and thereafter is closed to stop the flow of the sand into the furnace.

7. The sanding hopper system of claim 1, further comprising an image capture device operatively coupled to the hopper assembly, wherein the image capture device is configured for removable positioning over the chimney hole by moving the hopper assembly into an image capture position different from the retracted position and the sand dispensing position, and wherein the image capture device allows a user to determine if the by-products have at least been partially removed from the chimney hole or if the tap hole has been properly supplied with the sand.

8. The sanding hopper system of claim 5, wherein the chimney assembly further comprises rails and a door transport component that allows the chimney door to move to the open and closed positions through the relative movement of the door transport component with respect to the rails.

9. A sanding hopper supply method, comprising:

automatically opening a chimney door to provide access to a chimney hole in order to access a tap hole in a furnace, wherein the furnace is located at least partially below the chimney hole, and wherein automatically opening the chimney door comprises automatically opening the chimney door through at least one chimney rail and a door transport component that are operatively coupled to the chimney door and that allow the chimney door to move between open and closed positions through the relative movement of the transport component with respect to the at least one rail;

automatically moving a plunger to a plunger position over the chimney hole to remove by-products of steelmaking from the chimney hole;

automatically removing the plunger from the plunger position over the chimney hole;

automatically moving a sand dispenser to a sand dispensing position over the chimney hole to dispense sand from a hopper into the tap hole in the furnace, wherein the sand dispenser is part of a hopper assembly, the hopper assembly comprising at least the hopper configured for holding sand, and the sand dispenser, and wherein moving the sand dispenser to the sand dispensing position over the chimney hole comprises moving the hopper assembly to the sand dispensing position;

automatically removing the sand dispenser from the sand dispensing position over the chimney hole, wherein removing the sand dispenser from the sand dispensing position over the chimney hole comprises moving the hopper assembly to the retracted position or another position; and automatically closing the chimney door.

10. The sanding hopper supply method of claim 9, wherein the plunger is operatively coupled to the hopper assembly, and wherein automatically moving the plunger to, and automatically removing the plunger from, the plunger position over the chimney hole comprises automatically moving the hopper assembly to the plunger position and to a retracted position or another position.

11. The sanding hopper supply method of claim 9, further comprising:

automatically actuating the plunger into at least a portion of the chimney hole; and thereafter automatically retracting the plunger from the chimney hole to remove steelmaking by-products from the chimney hole.

12. The sanding hopper supply method of claim 9, wherein the plunger further comprises one or more projections, may rotate along the center line of the plunger, or may rotate outside of the centerline of the plunger for clearing by-products from the chimney hole.

13. The sanding hopper supply method of claim 9, wherein the chimney hole is positioned on a roof at a top of a furnace, and the sanding hopper assembly is positioned above the roof of the furnace and moved to the positions above the roof.

14. The sanding hopper supply method of claim 9, further comprising:

automatically opening the sand dispenser to allow sand from the hopper to enter the tap hole in the furnace; and automatically closing the sand dispenser to stop the flow of the sand into the tap hole.

15. The sanding hopper supply method of claim 9, further comprising:

determining, through the use of an image capture device, when the by-products have at least been partially removed from the chimney hole or when the tap hole has been properly supplied with sand, wherein the image capture device is operatively coupled to the hopper assembly, and wherein the image capture device is configured for removable positioning over the chimney hole by moving the hopper assembly into an image capture position different from the retracted position and the sand dispensing position.

16. The sanding hopper supply method of claim 9, wherein the hopper assembly further comprises a hopper transport component and is configured for operatively coupling to rails in a sanding hopper system; and wherein automatically moving and automatically removing the plunger and the sand dispenser comprises automatically moving the hopper assembly between the positions by the rails.

17. A sanding hopper system, comprising:

a hopper assembly comprising a hopper, wherein the hopper assembly is configured for holding sand and dispensing sand through a chimney hole into a tap hole in a furnace;

a plunger comprising one or more projections, wherein the plunger may rotate along the center line of the plunger, or my rotate outside of the centerline of the plunger, wherein the plunger is configured for removable positioning over the chimney hole for removing steelmaking by-products from the chimney hole; and a sand dispenser operatively coupled to the hopper assembly, wherein the sand dispenser is configured for removable positioning over the chimney hole when the hopper assembly is in a sand dispensing position, and wherein the sand dispenser is configured for supplying sand to the tap hole in the furnace between steelmaking heats.

18. The sanding hopper system of claim 17, further comprising:

a chimney assembly, wherein the chimney assembly comprises a chimney door and the chimney hole for accessing the furnace in a steelmaking facility, and wherein the chimney door is configured for opening and closing the chimney hole for access to the furnace.

19. A sanding hopper system, comprising:

a chimney assembly, wherein the chimney assembly comprises:

a chimney door and a chimney hole for accessing a furnace in a steelmaking facility;

at least one chimney rail and a door transport component operatively coupled to the chimney door; and wherein the at least one chimney rail and the door transport component allows the chimney door to automatically move between an open position for accessing the furnace and a closed position through the relative movement of the door transport component with respect to the at least one chimney rail;

a hopper assembly comprising a hopper, wherein the hopper assembly is configured to move between at least a retracted position and a sand dispensing position over a chimney hole in the furnace, and wherein the hopper of the hopper assembly is configured to hold sand;

a plunger, wherein the plunger is configured for removable positioning over the chimney hole for removing steelmaking by-products from the chimney hole; and a sand dispenser operatively coupled to the hopper assembly, wherein the sand dispenser is configured for removable positioning over the chimney hole when the hopper assembly is in the sand dispensing position for supplying sand to a tap hole in the furnace between steelmaking heats.

* * * * *